US010161149B2

(12) United States Patent
Liu

(10) Patent No.: US 10,161,149 B2
(45) Date of Patent: Dec. 25, 2018

(54) FRAME POOL

(71) Applicant: Bestway Inflatables & Material Corp., Shanghai (CN)

(72) Inventor: Feng Liu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 14/793,667

(22) Filed: Jul. 7, 2015

(65) Prior Publication Data

US 2016/0201348 A1 Jul. 14, 2016

(30) Foreign Application Priority Data

Jan. 12, 2015 (CN) ..... 2015 2 0017165 U

(51) Int. Cl.
*E04H 4/00* (2006.01)

(52) U.S. Cl.
CPC ..... *E04H 4/0056* (2013.01)

(58) Field of Classification Search
CPC ..... E04H 4/0056
USPC ..... 4/506
See application file for complete search history.

(56) References Cited

U.S. PATENT DOCUMENTS 3,225,362 A * 12/1965 Barrera ..... E04H 4/0018 220/4.16
4,356,933 A * 11/1982 Connolly ..... B65D 88/16 220/495.08
5,083,327 A * 1/1992 Gillebaard ..... E04H 4/0056 220/4.16
5,592,702 A * 1/1997 Gillebaard, Jr. ..... E04H 4/0056 4/506
5,603,129 A 2/1997 Chou
6,389,616 B1 5/2002 Mussa
6,571,405 B1 6/2003 Saputo et al.
6,643,858 B2 11/2003 Lee
(Continued)

FOREIGN PATENT DOCUMENTS

CN 200949321 Y 9/2007
CN 200968073 Y 10/2007
(Continued)

OTHER PUBLICATIONS

Declaration of Matthew Whalen, 10 pages, Dated and Signed May 22, 2018.

(Continued)

*Primary Examiner* — Christine Skubinna
(74) *Attorney, Agent, or Firm* — A J Moss; Dickinson Wright PLLC

(57) ABSTRACT

A frame pool having a plurality of vertical support tubes, a plurality of horizontal support tubes, a pool body comprising a pool bottom and a pool wall, and a reinforcing band having a continuous annular shape and provided between the inner side of the vertical support tubes and an outer surface of the pool wall. The reinforcing band entirely or partially covering the perimeter of the pool body and being fitted with the pool wall. A fixing band having a continuous annular shape is provided about an outer surface of the reinforcing band and of the vertical support tubes. At least one fixing device is fixedly coupled to the reinforcing band, wherein the fixing band passes through the fixing device.

10 Claims, 4 Drawing Sheets

(56) References Cited

U.S. PATENT DOCUMENTS

| | | | | |
|---|---|---|---|---|
| 2004/0040082 | A1* | 3/2004 | Fireman | E04H 4/0025 4/506 |
| 2004/0259444 | A1 | 12/2004 | Lin et al. | |
| 2009/0205121 | A1* | 8/2009 | Cheng | E04H 4/0056 4/506 |

FOREIGN PATENT DOCUMENTS

| | | |
|---|---|---|
| CN | 203097347 U | 7/2013 |
| EP | 15183281.3 | 5/2016 |

OTHER PUBLICATIONS

Intex Above Ground Pools, Marketing Brochure, Intex Marketing Ltd., 33 pages (2010).
Intex Above Ground Pools, Marketing Brochure, Intex Marketing Ltd., 48 pages (2012).
Intex Above Ground Pools, Marketing Brochure, Intex Marketing Ltd., 50 pages (2014).
Intex Development Company, Ltd., Invoices and Online Catalog Information, 77 pages (2010).

* cited by examiner

FRAME POOL

CROSS-REFERENCE TO RELATED APPLICATIONS

This application claims priority to Chinese Application No. 201520017165.X, entitled "FRAME POOL," filed on Jan. 12, 2015, the disclosure of which is incorporated by reference herein in its entirety.

BACKGROUND INFORMATION

1. Technical Field

The present disclosure relates to a pool, and more particularly to a reinforced above-ground pool including support tubes and a flexible pool body.

2. Background

Above ground pools are now very popular, especially in the United States and Europe. Above ground pools may be installed on lawns, pavement, cement floors, or other surfaces for entertaining adults and children.

The above ground pools have a variety of structures and forms. A circular frame pool is one of typical above ground pool that is mainly composed of horizontal support tubes, vertical support tubes and a pool body of a flexible reinforced polyvinyl chloride (PVC) rubberized fabric material. The pool body comprises a perpendicular pool bottom and a pool wall. The pool wall is mounted on the horizontal support tubes. A fixing band is provided on the pool wall for fixing the vertical support tubes, and vertical support tubes are provided between the fixing band and the pool wall.

When a frame pool of this structure is fully filled with water, the water can exert a significant amount of pressure on the pool wall, and the lower portion of the pool wall is subjected to a greater pressure than the upper portion of the pool wall. Such pressure distribution makes the lower portion of the pool wall prone to outward expansion and deformation. Since the vertical support tubes are close to the outer side of the pool wall, the pool wall will transversely press the vertical support tubes once it is expanded and deformed to a certain extent, so that the displacement of the vertical support tubes will occur, and it would be difficult for the fixing band to fix the vertical support tubes. This will directly affect the overall stability of the frame pool and cause safety issue, such that the pool tends to overturn and collapse which may result in injury accidents.

Thus, a need therefore exists for a frame pool that overcomes the disadvantages and safety risks found in currently known frame pools.

SUMMARY

With regard to the defects presently existing in the prior art, a technical problem to be solved by the present disclosure is to provide an improved frame pool in which the vertical support tubes are not easily moved, thus enhancing the overall stability of the frame pool and preventing the pool from collapsing due to inadvertent movement of the vertical support tubes.

In order to solve the above-mentioned technical problem, a frame pool is provided according to the teachings of the present disclosure. The frame pool includes a plurality of vertical support tubes, a plurality of horizontal support tubes, a pool body, a reinforcing band, a fixing band, and at least one fixing device.

The plurality of horizontal support tubes are coupled to the plurality of vertical support tubes. The horizontal support tubes together with the vertical support tubes form a support structure of the frame pool.

The pool body includes a pool bottom and a pool wall. The pool wall is coupled to an edge of the pool bottom and extends vertically upwards. The pool wall is provided at an inner side of the vertical support tubes.

The reinforcing band has a continuous annular shape and is provided between the inner side of the vertical support tubes and an outer side of the pool wall. The reinforcing band entirely or partially covers the perimeter of the pool body and is fitted with the pool wall.

The fixing band has a continuous annular shape and is provided about an outer side of the reinforcing band and vertical support tubes. At least one fixing device is fixedly coupled to the reinforcing band. The fixing band passes through the fixing device.

In some implementations, the plurality of vertical support tubes are spaced apart from one another in an annular shape, and the plurality of horizontal support tubes are connected to the plurality of vertical support tubes via a plurality of T-shaped connectors, such that the horizontal support tubes are connected in an annular shape.

In some implementations, the pool body further includes support tube sleeves provided at an upper edge of the pool wall. The horizontal support tubes pass into the support tube sleeve with the T-shaped connectors being exposed.

In some implementations, the pool body is made of a flexible rubberized fabric.

In some implementations, the fixing device includes a sheet of material forming a loop with the reinforcing band, a ring-shaped collar, or an attachment member having a slot.

In some implementations, the pool body, the reinforcing band, the fixing band, and the fixing device are made from a flexible reinforced PVC rubberized fabric comprising two layers of PVC rubberized fabric and one layer of mesh fabric sandwiched therebetween.

In some implementations, the mesh fabric is a nylon mesh fabric or a polyester mesh fabric.

In some implementations, the fixing device is a plastic injection molded part or a rubber injection molded part.

In some implementations, the vertical support tubes, the horizontal support tubes and the T-shaped connectors are made of a hard metal tube or an injection molded hard plastic tube having a D-shaped, elliptical or circular cross section.

In some implementations, the reinforcing band is coupled to the pool wall and the fixing device is coupled to the reinforcing band by high-frequency welding.

Compared with prior art above ground pools, the present disclosure has several advantages. For example, the present disclosure provides a reinforcing band between the inner side of the vertical support tubes and the outer side (such as the lower half) of the pool wall which is most susceptible to expansion and deformation when the frame pool is filled with water. The structure effectively alleviates the expansion and deformation of the pool wall.

Meanwhile, a fixing band is provided where expansion and deformation of the pool wall are the minimal, i.e., at the outer side of the reinforcing band and the vertical support tubes, thereby greatly reducing the outward thrust forces of the pool wall against the vertical support tubes. The cooperation of the fixing band and the fixing device may effectively restrain or limit the position of the vertical support tubes, thus preventing the vertical support tubes from moving easily which, in turn, prohibits the outward displacement of the vertical support tubes.

The frame pool of the present disclosure greatly improves the overall stability of the support structure and minimizes the risk of collapse caused by movement of the vertical support tubes. The frame pool of the present disclosure has a safe and a simple structure that is easy to install and disassemble.

Other devices, apparatus, systems, methods, features and advantages of the disclosure will be or will become apparent to one with skill in the art upon examination of the following figures and detailed description. It is intended that all such additional systems, methods, features and advantages be included within this description, and be protected by the accompanying claims.

BRIEF DESCRIPTION OF THE DRAWINGS

The above-mentioned and other features, properties and advantages of the present disclosure may be better understood by referring to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

The present disclosure will be further described below in conjunction with particular example implementations and the accompanying drawings. Further details are provided in the following description in order for the present disclosure to be fully understood. However, the present disclosure can be implemented in various ways other than those described herein. A person skilled in the art can make similar analogies and modifications according to practical applications without departing from the spirit of the present disclosure, and therefore the contents of the particular examples herein should not be construed as limiting to the scope of the present disclosure.

Figure 1:
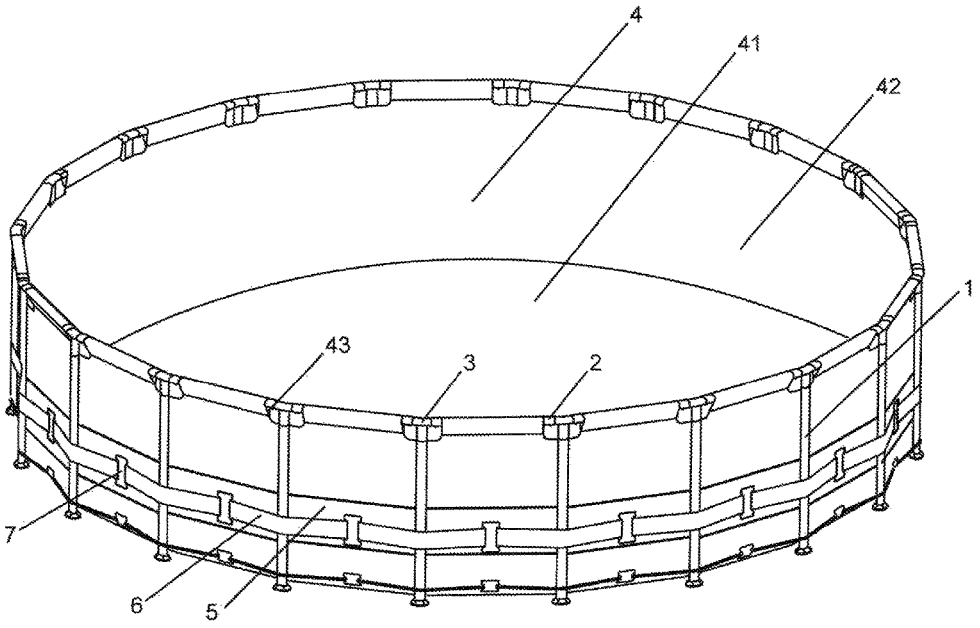
FIG. 1 is a perspective view illustrating a first example of a frame pool according to an implementation of the present disclosure.

FIGS. 1-7 illustrate various implementations of an above ground pool according to the teachings of the present invention. In particular, FIG. 1 is a perspective view illustrating a first example of a frame pool according to an implementation of the present disclosure.

As shown in FIG. 1, the frame pool mainly includes a plurality of vertical support tubes 1, a plurality of horizontal support tubes 2, a pool body 4, a reinforcing band 5, a fixing band 6 and at least one fixing device 7. The plurality of vertical support tubes 1 may be arranged spaced apart from one another in an annular shape, and the plurality of horizontal support tubes 2 are connected to the plurality of vertical support tubes 1 via a plurality of T-shaped connectors 3. The horizontal support tubes 2 are connected in an annular arrangement by means of the T-shaped connectors 3. The horizontal support tubes 2 and the vertical support tubes 1 form a support structure of the frame pool. In order to ensure adequate support strength, the vertical support tubes 1, the horizontal support tubes 2 and the T-shaped connectors 3 may be constructed of high-strength hard metal tubing (e.g., steel tubing) or hard injection molded tubing with a D-shaped, elliptical or circular cross-section.

The pool body 4, as a water-holding container, may be made of a flexible rubberized fabric, including a flexible reinforced PVC rubberized fabric with two layers of PVC rubberized fabric and one layer of mesh fabric sandwiched therebetween. According to this example, the mesh fabric may be a nylon mesh fabric or a polyester mesh fabric.

The pool body 4 mainly includes a pool bottom 41 and a pool wall 42. In the example shown, the pool bottom is circular, but in other implementations, the pool bottom 41 may be rectangular, polygonal, or some other geometric shape. The pool wall 42 is connected to an edge of the pool bottom 41 and vertically extending upwards, so as to form a container capable of containing water. The pool wall 42 is provided at an inner side of the vertical support tubes 1.

Figure 2:
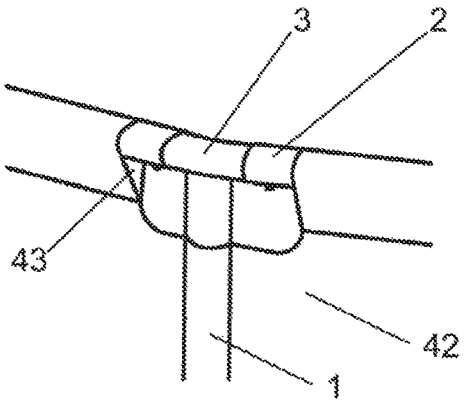
FIG. 2 is an enlarged partial perspective view of the frame pool illustrated in FIG. 1, showing how corresponding horizontal supports are connected to a T-shaped connector of the vertical support tubes.

FIG. 2 is an enlarged partial perspective view of the frame pool illustrated in FIG. 1. Referring now to FIGS. 1 and 2, the pool body 4 may further include support tube sleeves 43 provided at an upper edge of the pool wall 42. As such, the horizontal support tubes 2 may pass through the support tube sleeve 43 with the T-shaped connectors 3 being exposed.

When the pool body 4 is fully filled with water, the lower portion of the pool wall 42 is subjected to a greater pressure of the water than the upper portion of the pool wall 42, and is susceptible to expansion and deformation.

Figure 3:
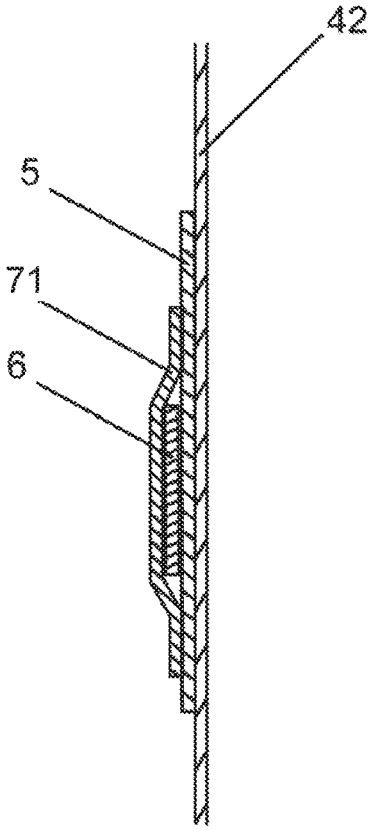
FIG. 3 is a partial cross-sectional view of the pool wall of the frame pool illustrated in FIG. 1, showing the assembly of the fixing band within the fixing device.

FIG. 3 is a partial cross-sectional view of the pool wall 42, illustrating how the fixing band 6 is assembled within the fixing device 7. Referring now to FIGS. 1 and 3, in order to address the problem of outward expansion and deformation of the lower half of the pool wall 42, a reinforcing band 5 having a continuous annular shape may be provided about the lower half of the outer surface of the pool wall 42 and at the inner side of the vertical support tubes 1. The reinforcing band 5 may entirely or partially covers the perimeter of the pool body 4 and is fitted with and fixedly connected to the pool wall 42 by means of high-frequency welding (high-frequency thermo-bonding) or other suitable means. The reinforcing band 5 functions to increase the strength of the pool wall 42, substantially reducing the magnitude of outward expansion and deformation of the pool wall 42, and reducing or avoiding the force exerted on the vertical support tubes 1 outside the reinforcing band 5.

The fixing band 6 has a continuous annular shape and is provided about the outer surface of the reinforcing band 5 and around the vertical support tubes 1. At least one fixing device 7 is fixedly coupled to the reinforcing band 5 by means of high-frequency welding (high-frequency thermo-bonding) or other suitable means. In the example shown in FIG. 3, the fixing device 7 includes a fixing sheet 71. As shown, the fixing band 6 passes through the fixing device 7 such that the annular fixing band 6 is fixed to the reinforcing band 5 and the vertical support tubes 1 are secured against pool wall 4 in a permanent manner within the inner surface of the fixing band 6. Thus, the position of the vertical support tubes 1 may be fixed and outward displacement or movement of the vertical support tubes 1 may be restricted.

Of course, according to the present disclosure, the form of the fixing device 7 may vary and is not limited to the fixing sheet 71 with the upper and lower ends fixedly coupled to the reinforcing band 5, as shown in FIG. 3. The fixing sheet 71 includes a sheet of material that forms a loop with the reinforcing band 5 for passing the fixing band 6 therethrough. Other exemplary forms of the fixing device 7 will be further described below.

Figure 4:
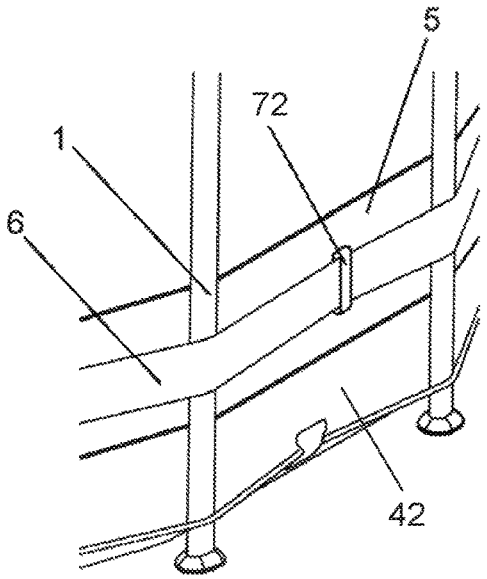
FIG. 4 is a partial perspective view of a second example of a frame pool according to an implementation of the present disclosure, where the fixing device includes a fixing ring.
Figure 5:
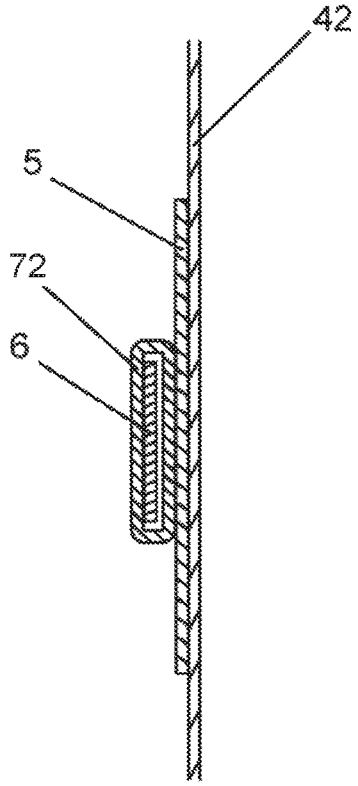
FIG. 5 is a partial cross-sectional view of the pool wall of the frame pool illustrated in FIG. 4, showing the assembly of the fixing band within the fixing ring.

FIG. 4 is a partial perspective view of a second example of a frame pool according to an implementation of the present disclosure. FIG. 5 is a partial cross-sectional view of the pool wall of the frame pool illustrated in FIG. 4. In the example shown in FIGS. 4 and 5, the fixing device 7 includes a fixing ring 72 comprising a ring-shaped collar that functions similar to the fixing sheet 71 described above.

Figure 6:
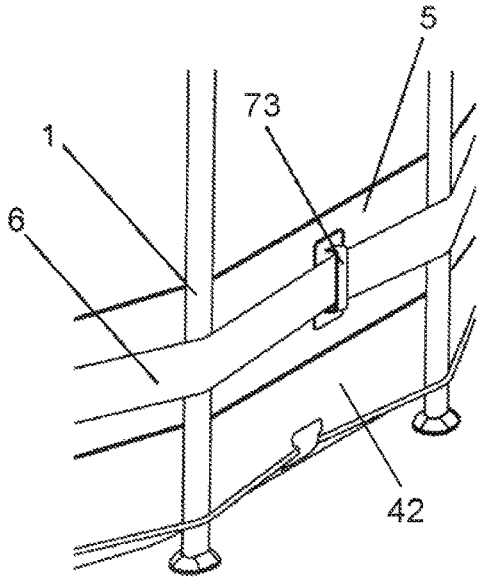
FIG. 6 is a partial perspective view of a third example of a frame pool according to an implementation of the present disclosure, where the fixing device includes a fixing part.
Figure 7:
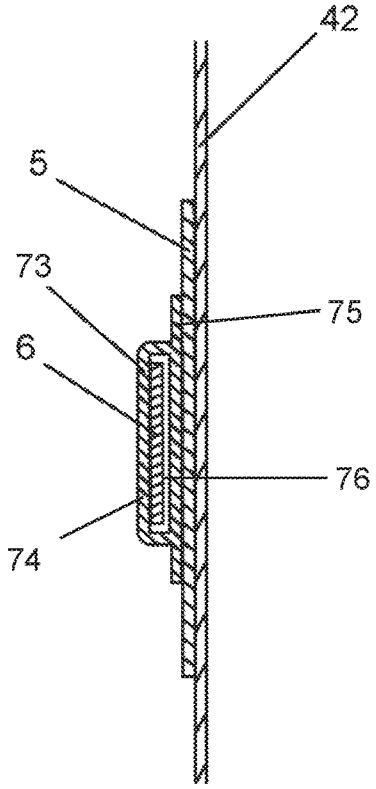
FIG. 7 is a partial cross-sectional view of the pool wall of the frame pool illustrated in FIG. 6, showing the assembly of the fixing band within the fixing part.

FIG. 6 is a partial perspective view of a third example of a frame pool according to an implementation of the present disclosure. FIG. 7 is a partial cross-sectional view of the pool wall of the frame pool illustrated in FIG. 6. In the example shown in FIGS. 6 and 7, the fixing device 7 includes a fixing part 73 comprising an a ring-shaped collar 74 and an attachment member 75 having a slot 76 that functions similar to the fixing sheet 71 described above.

According to the present disclosure, the material of the reinforcing band 5, the fixing band 6, the fixing sheet 71 and the fixing ring 72 may be the same reinforced PVC rubberized fabric as that of the pool body 4, i.e. the PVC rubberized fabric with two layers of PVC rubberized fabric and one layer of mesh fabric sandwiched therebetween, and the mesh fabric may be a nylon mesh fabric or a polyester mesh fabric. Moreover, the fixing part 73 may be a plastic injection molded part or a rubber injection molded part.

In summary, a reinforcing band 5 is provided between the inner side of the vertical support tubes 1 and the outer surface (such as the lower half) of the pool wall 42 which is most susceptible to expansion and deformation when the frame pool of the present disclosure is filled with water, so as to effectively reduce the expansion and deformation of the pool wall 42. Meanwhile, a fixing band 6 is provided where the expansion and deformation are the minimal, i.e., about the outer surface of the reinforcing band 5 and around the vertical support tubes 1, thereby greatly reducing outward thrust forces from the pool wall 42 exerted on the vertical support tubes 1. The cooperation of the fixing band 6 and the fixing device 7 may have various forms that effectively restrict or limit the position of the vertical support tubes 1, making movement of the vertical support tubes 1 difficult. This prevents outward displacement of the vertical support tubes.

Frame pools according to the teachings of the present disclosure greatly improve the overall stability of the support structure and avoid the risk of collapse caused by movement of the vertical support tubes of the pool. Frame pools of the present disclosure have a safe and a simple structure that is easy to install and disassemble.

While the exemplary frame pools described herein are described as having a generally circular shape, frame pools according to the present disclosure may be constructed to various shapes and sizes. In general, terms such as "coupled to," and "configured for coupling to," and "secured to," and "configured for securing to" and "in communication with" (for example, a first component is "coupled to" or "is configured for coupling to" or is "configured for securing to" or is "in communication with" a second component) are used herein to indicate a structural, functional, mechanical, electrical, signal, optical, magnetic, electromagnetic, ionic or fluidic relationship between two or more components or elements. As such, the fact that one component is said to be in communication with a second component is not intended to exclude the possibility that additional components may be present between, and/or operatively associated or engaged with, the first and second components.

The present disclosure has been described above in connection with example implementations which, however, are not intended to be limiting to the scope of the present invention, and any person skilled in the art should understand that these are merely illustrative and could make possible changes and modifications without departing from the spirit and scope of the present invention. Hence, any alteration, equivalent change and modification which are made to the above-mentioned examples in accordance with the technical substance of the present invention and without departing from the spirit of the present invention, would fall within the scope defined by the claims of the present invention.

What is claimed is:

1. A frame pool, comprising:

a plurality of vertical support tubes;

a plurality of horizontal support tubes coupled to said plurality of vertical support tubes, the horizontal support tubes and the vertical support tubes forming a support structure of the frame pool;

a pool body, comprising:

a pool bottom; and a pool wall coupled to an edge of the pool bottom and vertically extending upwards, the pool wall being disposed inside of the vertical support tubes;

a reinforcing band having a continuous annular shape, the reinforcing band being coupled to the pool wall between an inner side of the vertical support tubes and an outer surface of the pool wall, the reinforcing band entirely or partially covering the perimeter of the pool body and being fitted with the pool wall;

a fixing band having a continuous annular shape, the fixing band being disposed on the pool wall about an outer surface of the reinforcing band and the vertical support tubes; and at least one fixing device fixedly coupled to the reinforcing band wherein the fixing band passes through the fixing device and the at least one fixing device is disposed between and spaced apart from the plurality of vertical support tubes;

wherein the fixing band is fixedly coupled to the reinforcing band and the vertical support tubes are secured against the pool wall within an inner surface of the fixing band; and wherein the reinforcing band, the fixing band, and the at least one fixing device are spaced apart from the plurality of horizontal support tubes.

2. The frame pool of claim 1, wherein the plurality of vertical support tubes are spaced apart from one another in an annular arrangement, and the plurality of horizontal support tubes are coupled to the plurality of vertical support tubes via a plurality of T-shaped connectors such that the horizontal support tubes are coupled together to form an annular shaped structure.

3. The frame pool of claim 2, wherein the pool body further comprises support tube sleeves provided at an upper edge of the pool wall, and wherein the horizontal support tubes pass through the support tube sleeve with the T-shaped connectors being exposed.

4. The frame pool of claim 3, wherein the pool body is made of a flexible rubberized fabric.

5. The frame pool of claim 4, wherein the fixing device is one of a sheet of material forming a loop with the reinforcing band, the fixing device comprising a ring-shaped collar, an attachment member, and a slot for passing the fixing band therethrough.

6. The frame pool of claim 5, wherein the pool body, the reinforcing band, the fixing device are made from a reinforced PVC rubberized fabric comprising two layers of PVC rubberized fabric and an intermediate layer of mesh fabric sandwiched therebetween.

7. The frame pool of claim 6, wherein the mesh fabric is a nylon mesh fabric or a polyester mesh fabric.

8. The frame pool of claim 5, wherein the attachment member is a plastic injection molded part or a rubber injection molded part.

9. The frame pool of claim 2, wherein the vertical support tubes, the horizontal support tubes, and the T-shaped connectors are made of a hard metal tube or a hard injection molded tube, and wherein the hard metal tube or the hard injection molded tube has a D-shaped cross-section, an elliptical cross-section, or circular cross-section.

10. The frame pool of claim 1, wherein the reinforcing band is coupled to the pool wall and the fixing device is coupled to the reinforcing band by high-frequency welding.

* * * * *